US008468762B2

(12) United States Patent
Lizarazu

(10) Patent No.: US 8,468,762 B2
(45) Date of Patent: Jun. 25, 2013

(54) STRUT ACCESSORY FOR LINING A WALL AND INCLUDING MEMBRANE CLAMPING CLAWS, AND WALL LINING DEVICE INCLUDING SUCH ACCESSORY

(75) Inventor: Dominica Lizarazu, Paris (FR)

(73) Assignee: Saint-Gobain Isover, Courbevoie (FR)

( * ) Notice: Subject to any disclaimer, the term of this patent is extended or adjusted under 35 U.S.C. 154(b) by 110 days.

(21) Appl. No.: 12/810,971

(22) PCT Filed: Dec. 24, 2008

(86) PCT No.: PCT/FR2008/001825

§ 371 (c)(1),
(2), (4) Date: Oct. 4, 2010

(87) PCT Pub. No.: WO2009/103911

PCT Pub. Date: Aug. 27, 2009

(65) Prior Publication Data

US 2011/0016816 A1 Jan. 27, 2011

(30) Foreign Application Priority Data

Dec. 28, 2007 (FR) ..... 07 09170

(51) Int. Cl.

| | |
|---|---|
| ***E04B 1/74*** | (2006.01) |
| ***E04B 5/00*** | (2006.01) |
| ***E04B 1/38*** | (2006.01) |
| ***E04B 2/00*** | (2006.01) |
| ***F16B 21/00*** | (2006.01) |
| ***E02D 3/02*** | (2006.01) |
| ***A44B 1/04*** | (2006.01) |

(52) U.S. Cl.
USPC ..... 52/404.2; 52/506.05; 52/506.06; 52/512; 411/512; 405/302.1; 405/302.3; 24/297

(58) Field of Classification Search
USPC ..... 52/404.2, 404.5, 407.4, 410, 506.05, 52/506.06, 506.07, 509, 512, 584.1, 712; 411/512; 405/302.1, 302.3; 24/108, 114.3, 24/297, 453
See application file for complete search history.

(56) References Cited

U.S. PATENT DOCUMENTS

| | | | | |
|---|---|---|---|---|
| 2,376,279 | A * | 5/1945 | Schlenkert | 52/509 |
| 3,398,496 | A * | 8/1968 | Mischke | 52/463 |
| 3,426,489 | A * | 2/1969 | Lambert | 52/39 |
| 4,297,825 | A * | 11/1981 | Harper, Jr. | 52/837 |
| 4,302,913 | A * | 12/1981 | Schwartz et al. | 52/39 |
| 5,441,230 | A * | 8/1995 | Sambleson | 248/495 |
| 5,933,929 | A * | 8/1999 | Kawakami et al. | 24/681 |
| 6,453,633 | B1 * | 9/2002 | Wilkinson et al. | 52/506.06 |
| 7,562,690 | B1 * | 7/2009 | Loweth | 160/330 |

FOREIGN PATENT DOCUMENTS

| | | |
|---|---|---|
| CH | 598 438 | 4/1978 |
| DE | 1 609 373 | 3/1970 |
| FR | 2 822 179 | 9/2002 |
| FR | 2 852 989 | 10/2004 |
| FR | 2 878 876 | 6/2006 |

* cited by examiner

*Primary Examiner* — Brian Glessner
*Assistant Examiner* — Omar Hijaz
(74) *Attorney, Agent, or Firm* — Oblon, Spivak, McClelland, Maier & Neustadt, L.L.P.

(57) ABSTRACT

A spacer accessory including: a shank extending in an axial direction, one end of which includes a mechanism for securing the shank to a structural element of the wall that is to be lined and the other end of which includes a mechanism assembling the shank with lining studwork; two claws surrounding the shank; and a mechanism locking the two claws against one another with axial clamping.

20 Claims, 2 Drawing Sheets

STRUT ACCESSORY FOR LINING A WALL AND INCLUDING MEMBRANE CLAMPING CLAWS, AND WALL LINING DEVICE INCLUDING SUCH ACCESSORY

FIELD OF THE INVENTION

The present invention relates in general to the lining of walls for insulating or esthetic purposes. It relates more specifically to a spacer accessory positioned transversally between the wall that is to be lined and a dry lining in order to keep the latter away from the wall that is to be lined.

BACKGROUND

A wall such as a vertical wall, a ceiling or a roof of a building is often lined, during renovation or new-build, in order to achieve or improve the acoustic or thermal insulation of the building or of a specific room. To do this, a dry lining (inner partition or false ceiling) is attached to lining studwork which is itself secured to structural elements of the wall that is to be lined, a set distance therefrom. A thermal and/or acoustic insulating sheet (often known as an insulation complex) is inserted between the wall that is to be lined and the dry lining.

The insulating sheet typically comprises, on the one hand, one or more layers of fibrous insulating material such as mineral wool and, on the other hand, at least one air barrier or vapor barrier membrane. This membrane is usually inserted between the layer of fibrous material and the dry lining, typically up against the lining, possibly inserted between two layers of fibrous material.

The lining studwork is secured to the structural elements of the wall that is to be lined using evenly spaced spacer accessories. Each spacer accessory comprises a main body in the form of a shank running transversally to the wall that is to be lined and to the dry lining, one end of which is provided with means for securing it to, such that it projects from, a structural element of the wall that is to be lined and the other end of which is provided with means for assembling it with the lining studwork. A spacer accessory such as this is known for example from document WO 2006/061538.

During installation, the insulating sheet is speared onto the shanks of the spacer accessories, creating numerous holes in the layers of fibrous material and, where appropriate, the membrane. This piercing of holes is particularly detrimental to the membranes because their permanent or selective sealing function is then impaired. The piercing of the membrane may also form the start of a tear which could spread if tension is applied to the membrane.

In order to offset this problem, it is known practice for the membrane to be positioned on the inside of the lining studwork, between the latter and the dry lining. The spacer accessory therefore does not pass through the membrane which can thus remain intact, at least initially.

However, this solution is only partial. Securing the dry lining to the lining studwork entails piercing the membrane using the fasteners (staples, screws, nails, etc), which, albeit to a lesser extent, impairs the sealing of the membrane.

Positioning the membrane in front of the lining studwork raises another technical problem: it leaves no gap between the membrane and the dry lining. Now, it often proves necessary to install various cables or pipes, such as water pipework, ventilation pipework, electrical or communications networks behind the dry lining. It is then difficult to conceive of running the cables and wiring accessories between the membrane and the dry lining. The cables would actually only be able to be secured suitably if openings were made in the membrane. There would also be the risk of the membrane being damaged or distorted by the cables or the trunking, fastening or connecting accessories.

Admittedly, these cables could be positioned behind the membrane, but there would then no longer be any possibility of accessing them for maintenance or for modifying the wiring setup without removing the membrane or making a hole therein. Furthermore, the cabling or wiring operations may, for logistic reasons or because of changes to requirements or technologies, occur after the wall has been lined, this likewise forcing the contractors who are not generally specialists in wall lining and insulation, to make holes in or remove the membrane.

SUBJECT OF THE INVENTION

It is one object of the present invention to offer another technical solution which makes it possible both to preserve the long-term integrity of the membrane and leave an easily accessible space behind the dry lining in which to install the wiring.

To this end, the invention proposes a spacer accessory designed for securing lining studwork to a structural element of a wall that is to be lined, comprising a shank extending in a direction said to be an axial direction, one end of which is provided with means for securing it to the structural element of the wall that is to be lined and the other end of which is provided with means for assembling it with the lining studwork, and two claws surrounding the shank and means of locking these two claws against one another with axial clamping.

Thus, after locking, the two claws trap the periphery of the opening created by the membrane being speared onto the shank and therefore form a kind of protective eyelet that limits this opening. The width of the opening is thereby controlled, making it possible to limit, or even eliminate, the circulation of air or vapor through the opening speared in the membrane. In addition, the claws mechanically hold the membrane, this in particular avoiding the starts of tears in the membrane.

Another subject of the invention is a device for lining a wall, comprising:

- at least one spacer accessory comprising a shank, one end of which is provided with means for securing it to a structural element of the wall that is to be lined and the other end of which is provided with means for assembling it with a dry lining,
- an air barrier, vapor barrier or vapor-check barrier membrane to be speared onto the shanks of the spacer accessories.

At least one of the spacer accessories is in accordance with the aforegoing features, its two claws after locking trapping the membrane between them at the periphery of the relevant opening speared in it.

Advantageously, the membrane is held by the claws of the spacer accessories behind the lining studwork, some distance from the dry lining. Thus, an empty space is reserved between the dry lining and the membrane in which space wiring or equipment can be installed without damaging the membrane.

Further nonlimiting and advantageous features of the spacer accessory according to the invention are as follows:

- it comprises means for ensuring sealing between at least one of the claws and the shank; this makes it possible to maintain continuity of sealing of the membrane in the region through which the spacer shank passes, in the manner of a stuffing box;

the claws after locking have a region (line or strip) of mutual contact that is continuous and closed on itself; the membrane is thus trapped along this region of contact circumscribing the hole in the membrane, so that continuous mechanical retention and sealing are achieved around the entire periphery of the speared hole;

the claw locking means comprise means of axially elastically returning the claws against one another; the elastic return means consist of inherent elasticity of at least one of the claws, the locking means operating under the stress of said inherent elasticity;

it comprises means of mechanical connection of at least one of the claws to the shank, axially immobilizing the claws; these mechanical connecting means advantageously coincide with the locking means and comprise, on the one hand, an axial end stop arranged on the shank to prevent the claw closest to the wall that is to be lined from being pushed in any further toward this wall and, on the other hand, an opposing axial end stop with which the other claw can engage under the stress of the elastic return means and which is arranged on the shank in such a way that, after engagement, it opposes the retraction force of this other claw applied by the elastic return means;

the means of securing the shank to the lining studwork are at least partially formed on at least one of the claws.

DETAILED DESCRIPTION OF ONE EMBODIMENT

The description which follows, in relation to the attached drawings, and given by way of nonlimiting example, will allow a good understanding of what the invention is and how it may be achieved.

Figure 1:
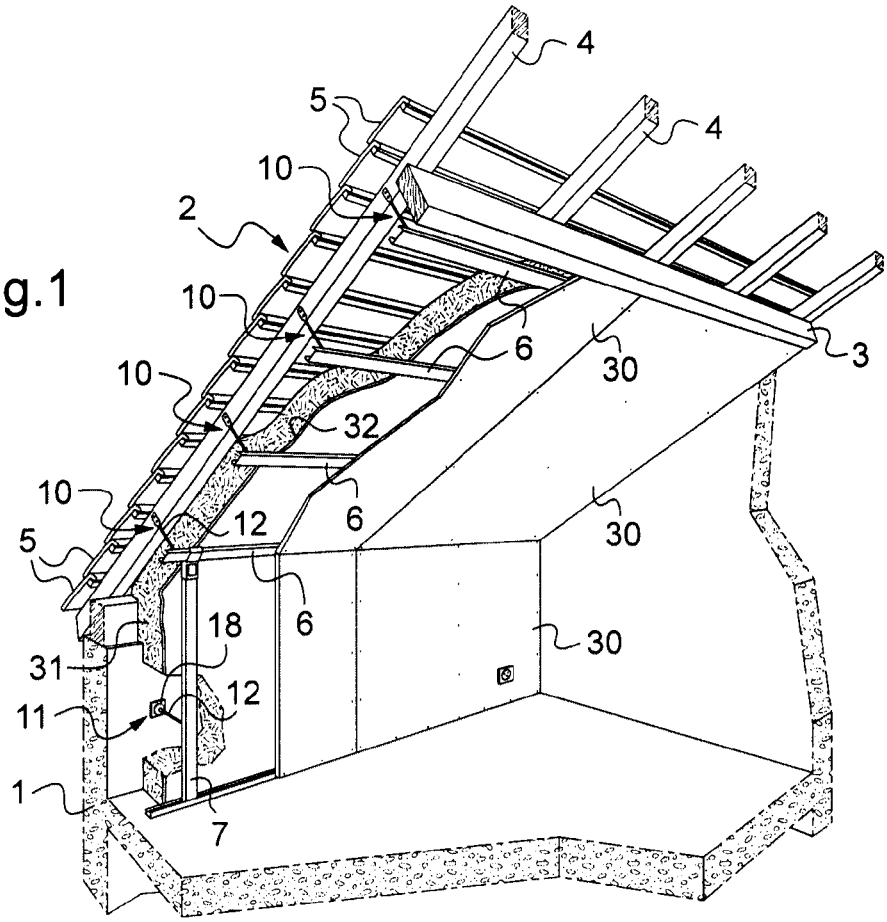
FIG. 1 is a perspective view with cutaway of the inside of the roof space of a building, the roof of which is insulated using a lining device according to the invention.

The overall proposition is to create insulating interior lining for the walls of a building. In the example illustrated in FIG. 1, this more specifically involves insulating the roof space of a building and, for this purpose, lining an exterior wall 1 and roofing 2 of this building.

The roofing 2 here comprises, in the conventional way, a wooden framework made up of purlins 3 bearing rafters 4 on which the roofing elements 5 rest.

A lining device according to the invention is attached to the roof framework and to the exterior wall. This lining device comprises lining studwork, made up on the one hand of horizontal battens 6 for lining the roofing and, on the other hand, of vertical battens 7 for lining the wall 1. These battens are commonly known as furring.

The lining battens 6 and 7 are respectively secured to structural elements of the roofing 2 and of the wall 1 that are to be lined, by means of a plurality of spacer accessories 10, 11.

Figure 2:
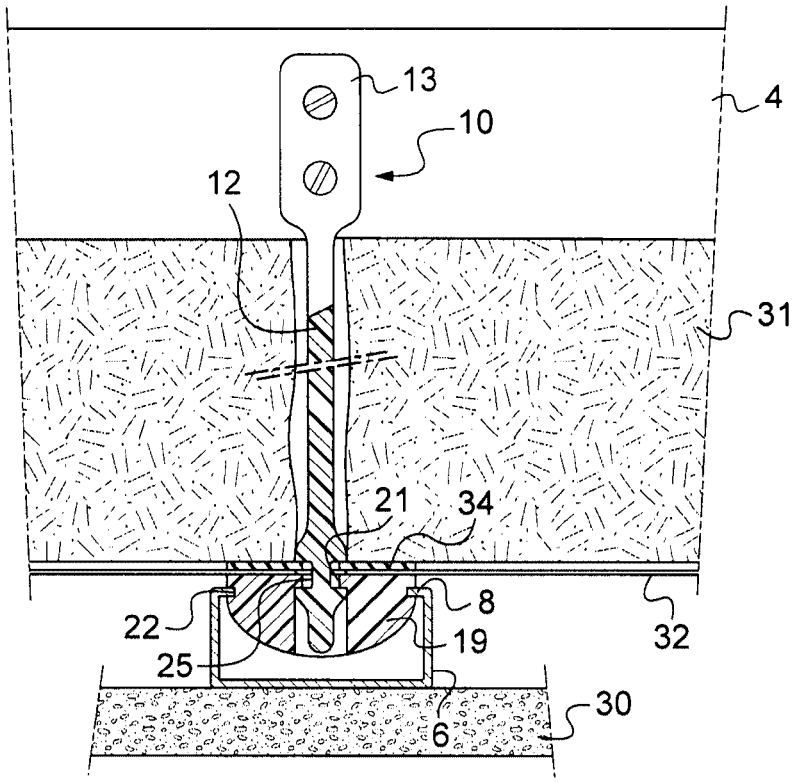
FIG. 2 is a view in section in a vertical plane, transverse to the purlins of the roofing and sectioning the spacer accessories according to the invention.
Figure 3:
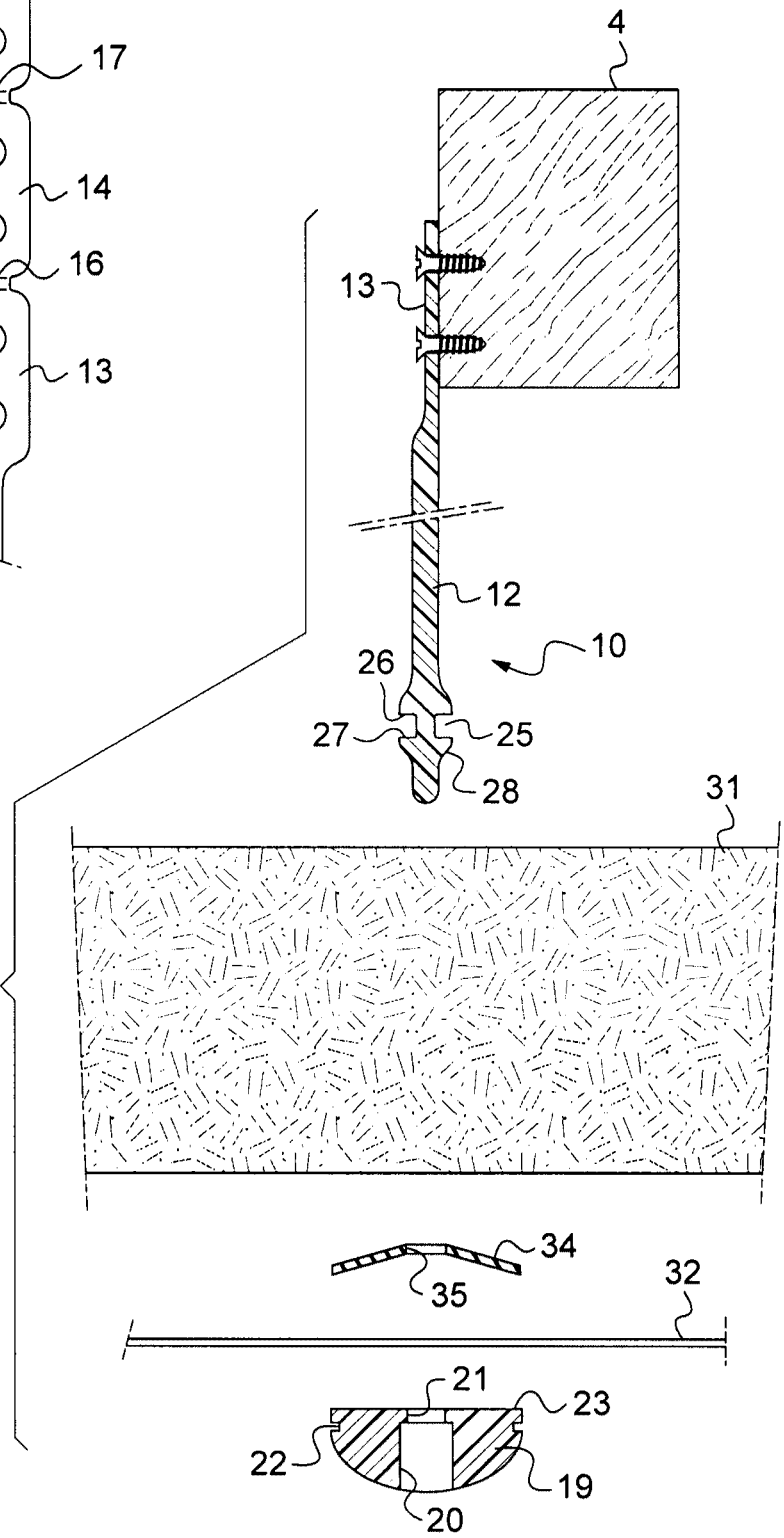
FIG. 3 is an exploded view in section in a vertical plane transverse to the stringers and sectioning the spacer accessories according to the invention.

With reference to FIGS. 1 to 3, each spacer accessory 10, 11 comprises a shank 12 of which one end, known as the rear end, is provided with means for securing it projectingly to the roofing 2 or to the wall 1 and of which the other end, known as the front end, is provided with means for assembling it with the batten 6, 7 that the accessory holds in place. On mounting, the shank 12 is arranged in such a way as to extend in a direction substantially perpendicular to the roofing 2 or to the wall 1.

The spacer accessories 10, also known as hangers, serve to line the roofing and are attached to the rafters 4. For this purpose they each comprise a longitudinal fixing plate 13 fitted to the rear end of the shank 12 and screwed to the flank of the appropriate rafter 4. The spacer accessories 11 are secured to the wall 1 by means of a transverse fixing plate 18 secured to the rear end of the shank and screwed to the wall 1.

Figure 4:
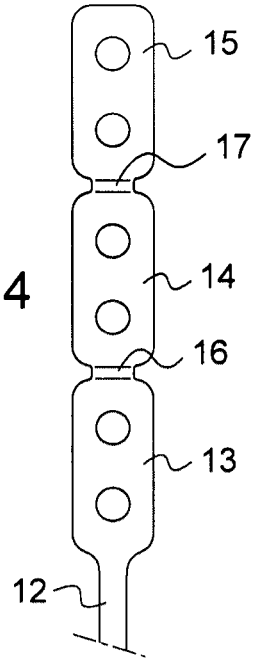
FIG. 4 is a detailed plan view of the rear end of the shank of the spearing accessory, equipped with a plurality of snap-off fixing plates.

According to an advantageous feature illustrated by FIG. 4, the spacer accessory 10 prior to mounting comprises a series of fixing plates running in the axial direction of the shank 12, in the continuation thereof. In this particular instance it is possible to make out three plates, the plate 13 and two others 14, 15. Any device comprising more than three plates or equivalent means notably having twelve to fifteen holes is conceivable.

Frangible regions 16, 17 are formed between the plates. These regions have lower mechanical bending strength about the direction of the battens 6, allowing the plates 14 or 15 to be detached by bending them by hand or using side cutters, in order to adjust the desired length. This adaptability particularly makes it possible to reduce the number of models of accessory that have to be manufactured and distributed and to avoid ordering or delivery errors which, if noticed belatedly on site, would delay the progress of the work.

Each spacer accessory thus has an overall length (corresponding to the distance between its furthest points in its longitudinal direction) typically of between 200 and 350 millimeters when provided with all its fixing plates and of between 80 and 150 millimeters when only the last fixing plate remains.

As an alternative, the spacer accessory comprises a single plate, for example in the form of a tab, provided with a multitude of longitudinal markings, preferably consisting of screw holes, intended to identify the position at which the accessory is to be secured to the rafter. Lines of weakness encouraging frangibility, or other markings may advantageously delineate frangible zones.

As is illustrated by FIGS. 2 and 3, the front end of the shank 12 is equipped with means of assembling it to the corresponding batten which in this instance is the horizontal batten 6 for lining the roofing. These means of assembly comprise a cap 19, here known as a key, attached to the front end of the shank 12.

Means of mechanically connecting this cap to the shank 12 after engagement oppose its being withdrawn forward but allow it to pivot at least partially about the shank 12.

In this particular instance, these mechanical connection means work like a clip. An annular groove 25 is formed on the front end of the shank 12 and has a rear flank 26 and a front flank 27 forming axial end stops. The cap 19 has a central opening 20 via which it can be pushed onto the front end of the shank 12. A restriction 21 is created in this central opening so that it can be forcibly engaged, like a clip, with the groove 25 once it has got past a hard point. This hard point is embodied by a conical collar 28 created in front of the groove 25 to form a clip-fastening ramp.

The assembly means finally comprise means for sliding clip-fastening of the cap 19 to the battens 6, 7.

Each batten 6, 7 is produced here in the form of a metal profiled section or furring, with a C-section having re-entrant edges 8 pointing toward one another so as to engage in the manner of a clip in an associated notch 22 belonging to the cap 19. To make it easier for the edges 8 of the batten to clip into the notches 22, the cap 19 has a convex front face acting like a ramp to force the branches of the battens elastically apart.

The shank 12 of each spacer accessory 10, 11 is made of plastic formed as an integral part of the fixing plates 13, 14, 15 and the groove 25. The cap 19 is made in the same way. Typically, a polymer or copolymer such as a polyamide may be used for the shank 12 and for the cap 19.

A dry lining 30 made up of sheets of lining material of the BA 13 plasterboard type are attached and secured by screws or rivets to the lining studwork formed by the battens 6, 7.

A thermal and/or acoustic insulating sheet is inserted between the wall that is to be lined (wall 1 and roofing 2) and the dry lining 30. This sheet comprises a thick layer 31 of fibrous insulating material such as mineral wool, of animal or plant origin. This layer 31 consists of a series of insulating felt panels or widths speared on the shanks 12 of the spacer accessories 10, 11. These insulating felts or panels are usually available in thicknesses of 65, 75, 85, 100, 200 or 240 millimeters.

The insulating sheet of said lining device additionally includes an air barrier, vapor barrier or vapor-check barrier 32 stretched against the thick insulating layer 30, between it and the battens 6, 7, and therefore speared on the shanks of the spacer accessories 10, 11. This membrane is, for example, of the moisture regulating type, having water vapor permeability that varies with the ambient humidity, such as those described in documents FR2884843 and WO96/33321. The thickness of this kind of membrane typically ranges between 5 and 100 micrometers.

The entire insulating sheet, with its layer of fibrous material and its membrane, is commonly known as an insulating complex. It may, as an alternative, comprise several layers of fibrous material and several membranes.

Because it has been speared on the shanks 12, the membrane 32 is perforated around each spacer accessory 10, 11 and means are provided according to the invention for re-establishing and doing so durably, the intactness of the air barrier, vapor barrier or vapor-check barrier function of this membrane.

Each spacer accessory for this purpose comprises two annular claws surrounding the shank and means of locking these two claws against one another with axial clamping, its two claws after locking trapping the membrane 32 between them at the periphery of the relevant opening speared in it.

It may be seen that this trapping is over a region of mutual contact that is continuous and closed on itself. This region of contact is, in this instance, like the claws, annular. However, by way of alternatives, other shapes of claws which, in their region of mutual contact, form a complete loop of any shape other than circular, for example of polygonal, oval, etc shape, may be envisioned.

One of these two claws in this particular instance consists of the cap 19 clipped onto the front end of the shank 12. The cap 19 therefore performs two functions: a function of assembling the battens 6, 7 with the spacer accessory 10, 11 for securing the lining studwork and a palliative function of trapping or "sandwiching" the membrane 32 in order to provide containment and plugging for the opening speared in it.

The other claw consists of a washer 34 having a central opening 35, the edge of which is clipped into the locking groove 25 of the shank 12. This washer 34 is of conical shape and able to deform elastically in order to flatten. This inherent elasticity of the washer 34 returns this washer against the rear face 23 of the cap 19. In this particular instance it is made of metal, for example mild stainless steel, but could equally be made of a plastic, like the cap 19, or a different plastic.

On mounting, the washer 34 is pushed onto the shank 12 of the spacer accessory 10, 11 after the thick insulating layer 31 has been speared on the shank 12. The washer 34 is forcibly pushed on to pass the collar 28 of the shank 12 and is then positioned in front of the layer 31, the edge of its central opening 35 resting against the rear flank 26 of the locking groove 25.

The membrane 32 is then speared onto the end of the shank 12 and pressed firmly against the washer 34 and the layer 31.

The cap 19 is in turn forcibly pushed onto the end of the shank 12 and compresses the membrane 32 against the washer 34. This push fitting is performed forcibly and the restriction 21 of the cap 19 crosses the hard point embodied by the collar 28. The washer 34, which was initially conical and the periphery of which is pushed back by the flat rear face 23 of the cap 19 deforms against the effect of its inherent elasticity to flatten out and, with the cap 19, trap the membrane 32 around the opening speared in it. When the cap 19 has been duly clipped onto the end of the shank 12, the membrane 32 is trapped by the washer 34 and the cap 19 with constant and predetermined trapping pressure and with clearances compensated for.

The cap 19 and the washer 34 are axially immobilized in the annular groove 25 and the membrane 32 is thus held by the cap 19 and the washer 34 of the spacer accessories 10, 11 behind the battens 6, 7 some distance from the dry lining 30. An empty space is thus created between the dry lining and the membrane and it is therefore possible to install wiring, pipes or equipment in this space without damaging the membrane.

In an alternative form that has not been depicted, instead of a clip assembly system provision may be made for the cap 19 to collaborate with the front end of the shank 12 by means of a screw-fastening or alternatively bayonet-fastening system.

In the case of a quarter-turn screw-fastening system of the bayonet type, the cap 19 enjoys axial travel, under the stress of the elastic return applied by the washer 34. An anti-rotation stop is created on the shank 12 to oppose unwanted disengagement of the quarter-turn locking system and which can be overcome only thanks to the aforementioned elastic axial travel.

Finally, means may also be provided for ensuring sealing between at least one of said claws of said spacer accessory and the shank thereof.

The invention claimed is:

1. A device for lining a wall, comprising:

at least one spacer accessory including a shank extending in an axial direction, a wall-side end of the shank having means for securing the shank to a structural element of the wall that is to be lined with a dry lining, and a lining-side end of the shank having means for assembling the shank with the dry lining; and an air barrier, vapor barrier, or vapor-check barrier membrane speared onto the shank of the spacer, wherein the spacer accessory further includes a wall-side claw and a lining-side claw, each of the claws surrounding the shank, and locking means for locking the claws against each other via axial clamping, such that, when locked, the claws clamp the membrane between the claws at a periphery of an opening through which the membrane has been speared, the locking means including an annular groove disposed in the lining-side end of the shank, and a portion of each of the wall-side claw and the lining-side claw entering within the groove so as to clamp the membrane.

2. The lining device as claimed in claim 1, wherein, after locking, the claws of the spacer accessory comprise a zone of mutual contact that is continuous and closed.

3. The lining device as claimed in claim 1, wherein the locking means of the spacer accessory comprises elastic return means for elastically returning the claws against each other in the axial direction.

4. The lining device as claimed in claim 3, wherein the elastic return means has inherent elasticity of at least one of the claws of the spacer accessory, the locking means working under stress of the inherent elasticity.

5. The lining device as claimed in claim 1, further comprising mechanical connection means for mechanically connecting at least one of the claws of the spacer accessory to the shank thereof, so as to axially immobilize the claws.

6. The lining device as claimed in claim 5, wherein the mechanical connection means and the locking means coincide in a connection-locking means.

7. The lining device as claimed in claim 6, wherein the connection-locking means of the spacer accessory comprises a wall-side axial end stop arranged on the shank to prevent the wall-side claw from being pushed in any further toward the wall-side end of the shank, and a lining-side axial end stop with which the lining-side claw engages under stress of an elastic return means of the lining-side claw and which is arranged on the shank such that, after engagement, the lining-side axial end stop opposes a retraction force of the lining-side claw applied by the elastic return means.

8. The lining device as claimed in claim 7, wherein the lining-side axial end stop is secured to the shank, fixed permanently on or formed as an integral part of the shank, and wherein the lining-side claw of the spacer accessory engages forcibly with the lining-side axial end stop.

9. The lining device as claimed in claim 7, wherein the lining-side claw of the spacer accessory collaborates with the lining-side axial end stop, to engage therewith, via a quarter turn assembly system such that, following engagement, the lining-side axial end stop axially travels under stress of the elastic return means and the quarter turn assembly system locks, preventing the lining-side claw from disengaging with the lining-side end stop by restricting rotation of the lining-side end stop about the axial direction.

10. The lining device as claimed in claim 1, wherein at least one of the claws of the spacer accessory includes means for securing the shank of the spacer accessory to lining studwork.

11. The lining device as claimed in claim 1, wherein the claws of the spacer accessory are disposed so as to hold the membrane behind lining studwork at a distance from the dry lining.

12. A spacer accessory configured to secure lining studwork to a structural element of a wall that is to be lined, comprising:

a shank extending in an axial direction, a wall-side end of the shank having means for securing the shank to the structural element of the wall that is to be lined with a dry lining, and a lining-side end of the shank having means for assembling the shank with the lining studwork;

a wall-side claw and a lining-side claw, each of the claws surrounding the shank; and locking means for locking the claws against each other via axial clamping, the means for locking the claws including elastic return means of the lining-side claw for elastically returning the claws against each other in the axial direction, the locking means including an annular groove disposed in the lining-side end of the shank, and a portion of each of the wall-side claw and the lining-side claw entering within the groove so as to be clamped.

13. The accessory as claimed in claim 12, wherein, after locking, the claws comprise a zone of mutual contact that is continuous and closed.

14. The accessory as claimed in claim 12, wherein the elastic return means has inherent elasticity of at least one of the claws, the locking means working under stress of the inherent elasticity.

15. The accessory as claimed in claim 12, further comprising mechanical connection means for mechanically connecting at least one of the claws to the shank, so as to axially immobilize the claws.

16. The accessory as claimed in claim 15, wherein the mechanical connection means comprises a wall-side axial end stop arranged on the shank to prevent the wall-side claw from being pushed in any further toward the wall-side end of the shank, and a lining-side axial end stop with which the lining-side claw engages under stress of the elastic return means of the lining-side claw and that is arranged on the shank such that, after engagement, the lining-side axial end stop opposes a retraction force of the lining-side claw applied by the elastic return means.

17. The accessory as claimed in claim 12, wherein at least one of the claws includes means for securing the shank to lining studwork.

18. The device as claimed in claim 1, wherein the means for securing the shank to a structural element of the wall that is to be lined comprises one or more fixing plates secured to the wall-side end of the shank.

19. The device as claimed in claim 12, wherein the means for securing the shank of the spacer accessory to a structural element of the wall that is to be lined comprises a series of fixing plates running in the axial direction and secured to the wall-side end of the shank, the series of fixing plates having frangible regions formed between the fixing plates.

20. An apparatus, comprising:

a shank extending in an axial direction, the shank including a fixing plate having at least one throughhole, the fixing plate being disposed on a first end of the shank, and an annular locking groove disposed in a second end of the shank;

a cap that is accommodated in the locking groove; and a washer having a conical shape, the washer being accommodated in the locking groove to be disposed adjacent to the cap, wherein the cap and the washer lock against each other via axial clamping in the locking groove, a portion of each of the cap and the washer entering within the locking groove so as to be clamped.

* * * * *